US010363578B2

(12) United States Patent
Valerio

(10) Patent No.: US 10,363,578 B2
(45) Date of Patent: Jul. 30, 2019

(54) SYSTEM, APPARATUS AND METHOD FOR SEPARATING MATERIALS USING A SCREEN BED AND VACUUM

(71) Applicant: TAV HOLDINGS, INC., Atlanta, GA (US)

(72) Inventor: Thomas A Valerio, Altanata, GA (US)

(73) Assignee: TAV HOLDINGS, INC., Atlanta, GA (US)

( * ) Notice: Subject to any disclaimer, the term of this patent is extended or adjusted under 35 U.S.C. 154(b) by 0 days.

(21) Appl. No.: 15/560,052

(22) PCT Filed: Mar. 20, 2016

(86) PCT No.: PCT/US2016/023329
§ 371 (c)(1),
(2) Date: Sep. 20, 2017

(87) PCT Pub. No.: WO2016/154077
PCT Pub. Date: Sep. 29, 2016

(65) Prior Publication Data

US 2018/0071785 A1 Mar. 15, 2018

Related U.S. Application Data

(60) Provisional application No. 62/136,144, filed on Mar. 20, 2015.

(51) Int. Cl.

| | |
|---|---|
| ***B07B 9/02*** | (2006.01) |
| ***B07B 9/00*** | (2006.01) |
| ***B07B 7/04*** | (2006.01) |
| ***B07B 1/15*** | (2006.01) |
| ***B07B 4/08*** | (2006.01) |
| ***B07B 7/086*** | (2006.01) |

(52) U.S. Cl.
CPC ..... *B07B 9/02* (2013.01); *B07B 1/155* (2013.01); *B07B 4/08* (2013.01); *B07B 7/04* (2013.01); *B07B 7/086* (2013.01); *B07B 9/00* (2013.01)

(58) Field of Classification Search
CPC .. B07B 9/00; B07B 9/02; B07B 1/155; B07B 7/04
USPC ..... 209/21, 22, 23, 24, 28
See application file for complete search history.

(56) References Cited

U.S. PATENT DOCUMENTS 2,722,312 A * 11/1955 Gear ..... B07B 9/02 209/19
5,740,922 A * 4/1998 Williams ..... A01D 17/06 209/668

(Continued)

FOREIGN PATENT DOCUMENTS

CN 201493245 U * 6/2010 ..... B07B 1/14
DE 19904796 A1 * 8/1999 ..... B07B 1/14

(Continued)

*Primary Examiner* — Terrell H Matthews
(74) *Attorney, Agent, or Firm* — Lewis Brisbois Bisgaard & Smith LLP; Nigamnarayan Acharya

(57) ABSTRACT

An apparatus/system for separating a mixture of solid materials has a screening bed, an expansion chamber in gaseous communication with the screening bed, a filter in gaseous communication with the expansion chamber, an air flow producer in fluid communication with the filter. The screening bed includes a star-shaped agitators and the air flow is a vacuum from the screening bed through pathway.

9 Claims, 6 Drawing Sheets

(56) References Cited

U.S. PATENT DOCUMENTS

| | | | | |
|---|---|---|---|---|
| 2011/0031166 | A1* | 2/2011 | Graham | B03B 9/061<br>209/19 |
| 2016/0136654 | A1* | 5/2016 | Yang | B03B 9/005<br>209/28 |

FOREIGN PATENT DOCUMENTS

| | | | | |
|---|---|---|---|---|
| EP | 1486256 | A1 * | 12/2004 | B03B 9/06 |
| EP | 2457671 | A2 * | 5/2012 | B07B 1/15 |

* cited by examiner

SYSTEM, APPARATUS AND METHOD FOR SEPARATING MATERIALS USING A SCREEN BED AND VACUUM

RELATED APPLICATIONS

This application claims the benefit of U.S. Provisional Patent Application 62/136,144, filed Mar. 20, 2015, which is incorporated herein by reference in its entirety.

FIELD OF THE TECHNOLOGY

This application relates to an apparatus for sorting materials. More specifically, this application relates to an apparatus that employs a screening device and an air aspiration/vacuum arrangement to sort and recover materials from a waste stream. The present disclosure has particular advantages in connection with effectively sorting waste streams that contain materials of varied size, densities, shapes and moisture content into distinct, sorted recyclable content.

BACKGROUND

Recycling of waste materials is highly desirable from many viewpoints, not the least of which arc financial and ecological. Properly sorted recyclable materials can often have significant monetary value. Many of the more valuable recyclable materials do not biodegrade within a short period, and therefore properly recycling these materials significantly reduces the strain on local landfills and ultimately the environment.

Typically, waste streams/mixtures are composed of a variety of types of waste materials. One such waste stream is generated from the recovery and recycling of automobiles or other large machinery and appliances. For example, at the end of its useful life, an automobile will be shredded. This shredded material can be processed (by one or more large drum magnets) to recover most of the ferrous metal contained in the shredded material. The remaining materials, referred to as automobile shredder residue (ASR), may still include ferrous and non-ferrous metals, including copper wire and other recyclable materials such as plastic.

ASR is mainly made of non-metallic material (dirt, dust, plastic, rubber, wood, foam, etc.), non-ferrous metals (mainly aluminum but also brass, zinc, stainless steel, lead, and copper) and some remaining ferrous metal that was not recovered by the first main ferrous recovery process (that is, the drum magnets). Recently, efforts have been made to recover additional materials from ASR, such as non-ferrous metals and plastics. Similar efforts have been made to recover white goods shredder residue (WSR), which are the waste materials left over after recovering ferrous metals from shredded machinery or large appliances. Other waste streams may include electronic components, typically referred to as electronic scrap, building components, retrieved landfill materials, waste incinerator ash-referred to as bottom ash, or other industrial waste streams. These materials generally are of value when they have been separated into like-type materials.

However, cost-effective methods are not available to effectively sort waste streams that contain diverse materials, especially when the waste stream contains materials with a number of diverse sizes, densities, shapes and moisture content. This deficiency has been particularly true for non-ferrous materials, and especially non-ferrous metals, including insulated copper wiring, and for non-metallic materials, such as high density plastics. This combination of diverse materials and diverse material sizes, densities, shapes and moisture content present a unique challenge in separating and recycling specific materials in an efficient manner.

Conventional known systems to concentrate or recover recyclable materials, specifically non-ferrous metals from waste streams, typically employ a first step composed of a screening device, such as a vibrating screen, rotating drum screens or star screens, which sort materials into similar size fractions. The term "screen" as used herein is intended to include any mesh-like sieve or grid-like device or perforated structure used to separate particles or objects. Long and thin pieces of metals, such as copper wire and stainless steel bars, present a unique challenge in screening materials from a waste stream because of the shape of such recyclables. Known screening processes other than a star or disc screen, such as vibrating screens or rotating drum screens, typically do not concentrate long and thin pieces of recyclables into one of the size fractions because of the three-dimensional shape of such recyclables. In some instances the long-thin recyclables can pass through the screen opening, but in other instances their length causes long-thin recyclable to remain on top of the screen. Once the recyclables have been screened into discrete size ranges, typically another step of conventional known systems to concentrate or recover recyclable materials may include an air separation apparatus that sorts the recyclables by their density into a light and heavy fraction.

Such screening and sorting technologies are typically implemented in two separate steps of the recycling or sorting processes thereby increasing their footprint, capital expenditure, and operating expense. In addition, they are limited in their ability to sort face sorting long and thin pieces of recyclable materials at high capacities and in a cost-effective manner. Moreover, high moisture content recyclables present a challenge during a typical screening and aspiration operation. The high moisture recyclables tend to block or clog the conventional screen's open area and when aspirated the high moisture recyclables tend to stick to each other, hampering the aspiration process.

Accordingly, there is always a need for improved processes and systems for sorting material. It is to this need that that this disclosure is directed.

SUMMARY

The present disclosure provides a screening apparatus or system combined with an aspiration air system to achieve a fluidization effect on recyclables. The screening apparatus may include star-shaped agitators. This allows for efficient, successful simultaneous size fraction sorting and density separation of recyclables, especially for recyclables with high moisture content and various shapes/sizes, such as long and thin pieces of recyclables like insulated copper wire. A majority of long and thin pieces of recyclables within a discrete size range are isolated, while at the same time recyclables with different densities are sorted with precision, despite the range of the recyclable sizes, shapes, densities, and moisture content present.

An aspect of the present disclosure relates to a screening bed for a star scalper/agitator with adjacent shafts. The star body may include a hub having radially protruding star fingers and an aperture where the star body is secured on a shaft of the star scalper. One or more of the star fingers may have a scraper attached near an extremity of the star finger(s). The scraper is arranged to scrape along the hub on an adjacent shaft of the star scalper. The star finger(s) may be flexible in an axial direction.

Another aspect of the present disclosure relates to an apparatus for separating a mixture including solid materials. The apparatus includes a separation chamber interspersed between a material intake and a material exit such that the mixture enters the separation chamber by way of the material intake and one of the solid materials of the mixture exits the separation chamber by way of the material exit. The separation chamber separates solid materials of the mixture from each other. The separation chamber includes an air intake and an air exit.

A star screen or bed carries and screens the mixture. As the mixture travels and is sorted through the stars of the screening bed, a fluidization chamber provides an upward stream of air between the star openings. The heavier fraction of the mixture continues its direction through the screening device while the lighter fraction is carried upward by the air stream. The lighter fraction of the material is directed to the expansion chamber. In the expansion chamber, a lighter fraction of the materials falls to the bottom of the expansion chamber as the velocity of the air slows. The air flows from the expansion chamber to a centrifugal filter that removes remaining material from the air. The air then travels to a fan that directs the filtered air back to the separation chamber or the surrounding atmosphere. The separated materials from the fluidization chamber that traveled to the expansion chamber are removed from the system at the bottom of the expansion chamber as well as the bottom of the centrifugal filter. Rotary Valves ("Air Locks") may be placed at these locations to prevent air from flowing through while still allowing the materials to pass.

One aspect of this disclosure includes a method and system to sort by weight and size. The heavier material that passed through the screening bed is sorted into different size fractions. The smaller sized materials are screened down through the star screen while the larger sized materials stay above the stars to be discharged at the end of the bed. Because of the fluidization effect and the velocity of the stars, the long and thin recyclables are concentrated at the end of the screening device. In addition, use of these two apparatuses in a single unit results in the recyclables becoming fluidized as they travel on the star screen bed, thereby improving the screening and density separation processes by greatly reducing the blinding or clogging of the screen while effectively and accurately sorting recyclables despite diverse ranges of shapes, sizes, densities, and moisture content.

DETAILED DESCRIPTION

Figure 1:
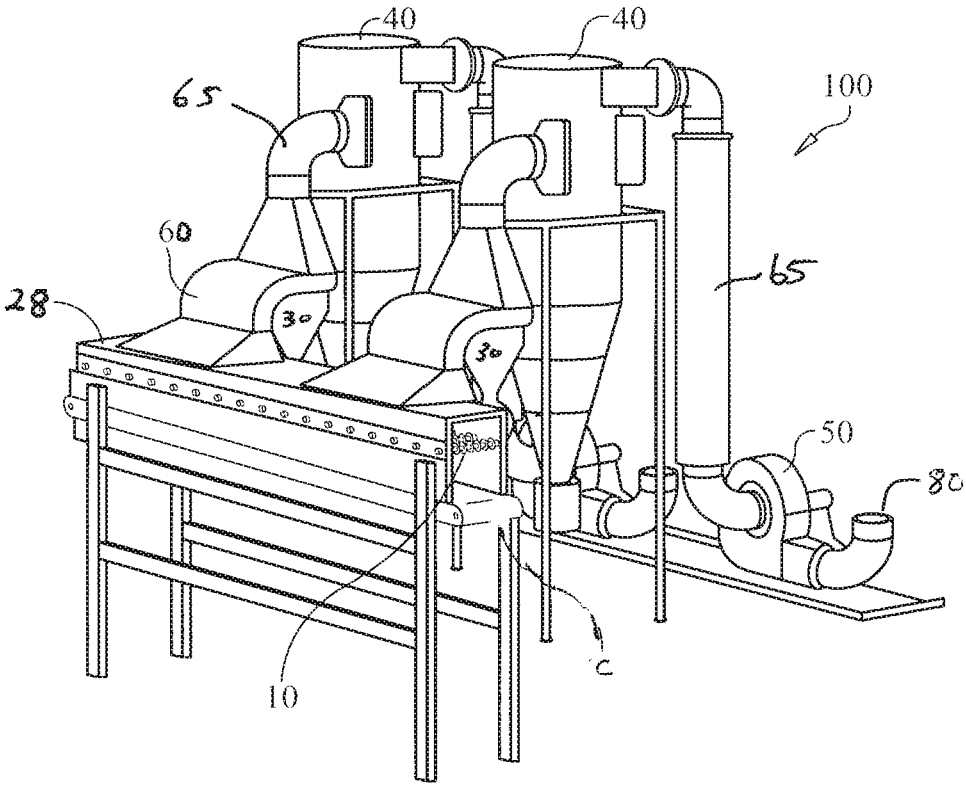
FIG. 1 is a perspective view of a fluidized aspirated screening apparatus according to the present disclosure.
Figure 2:
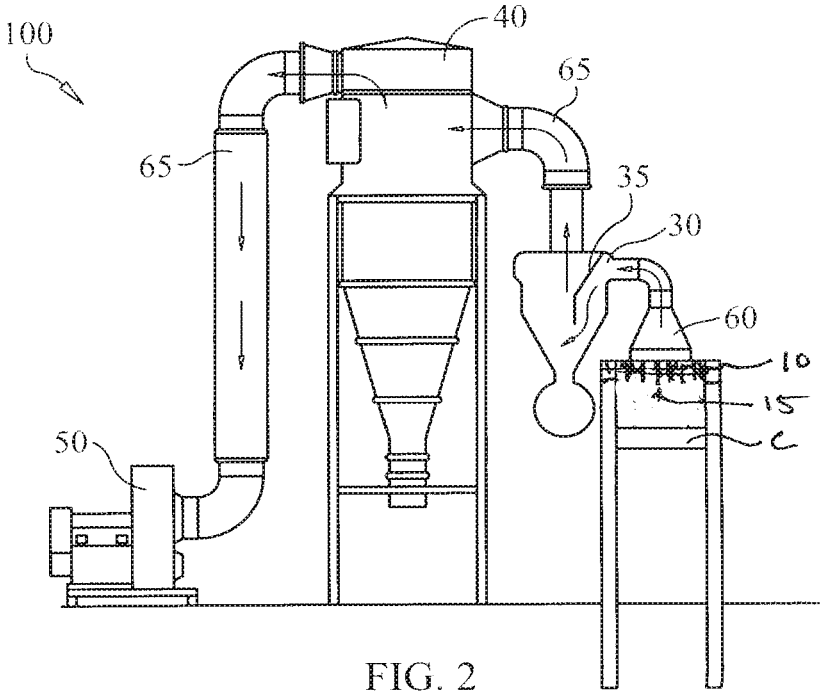
FIG. 2 is a cross-sectional side view of a fluidized aspirated screening apparatus according to the present disclosure.
Figure 3:
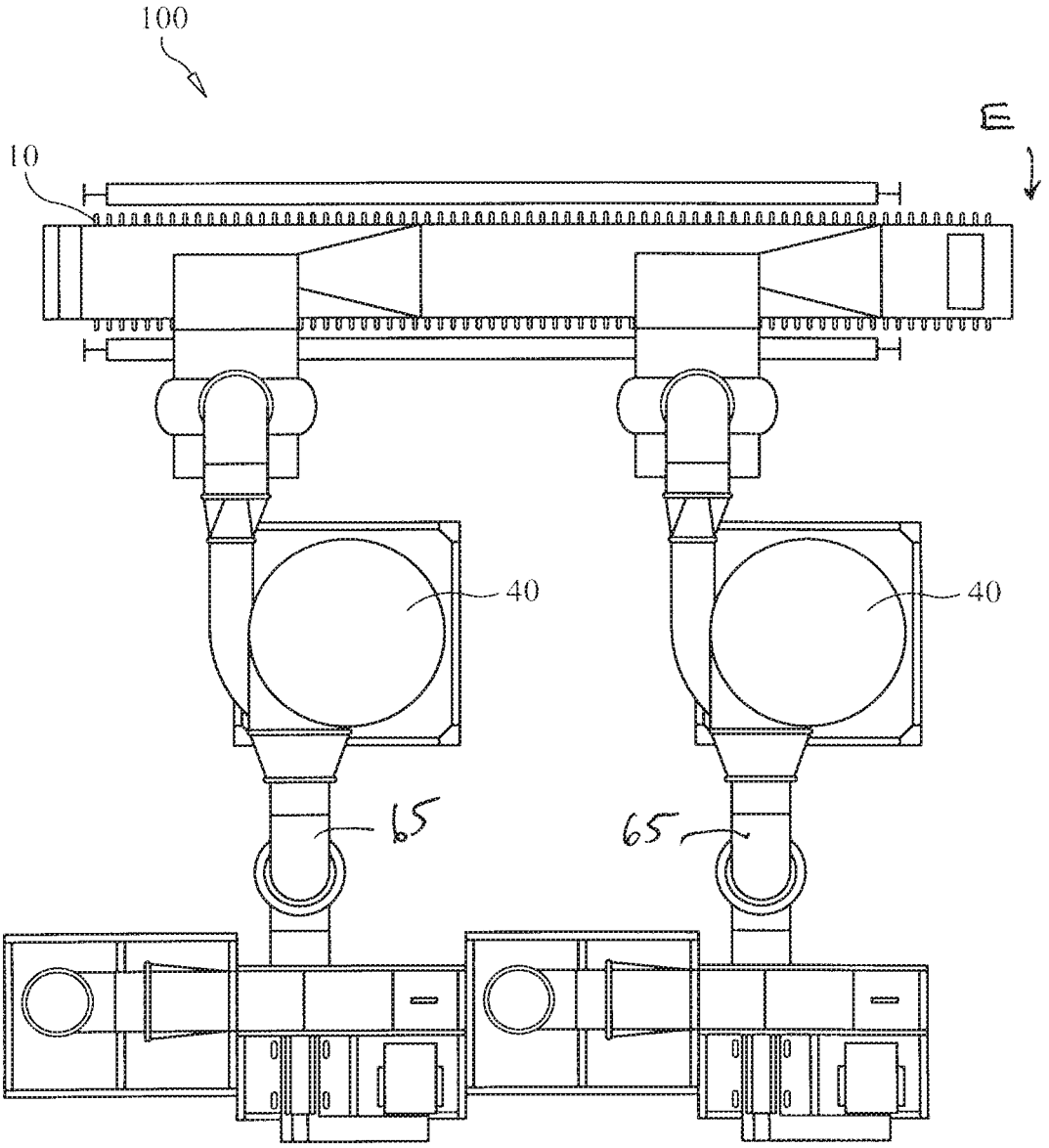
FIG. 3 is a top view of a fluidized aspirated screening apparatus according to the present disclosure.

Referring now to the drawings, exemplary embodiments are described in detail. FIGS. 1, 2, and 3 are perspective, side, and top views, respectively, of a fluidized aspirated screening apparatus/system 100 according to an exemplary embodiment. The system 100 can separate material into a first material, a second material, and a third material by weight and/or size and/or density.

FIG. 1 illustrates an exemplary equipment layout diagram of system/apparatus 100 in which material is fed into a screening bed 10. The screening bed 10 may be a bed having a plurality of shafts having one or more star agitators 15. Larger pieces and long-thin pieces that are not screened travel on top of the star screens or screening bed 10. The screening bed 10 can have a cover 28 (having side walls) to keep material along the screening bed or star bed 10 from arbitrarily falling out of the screening bed 10. The materials that travel along the screening bed 10 encounter a fluidization hood 60 (in fluid connection with an expansion chamber 30 and a filter 40, and the material is exposed to a vacuum or negative pressure (below atmospheric pressure). The fluidization chamber 60 is in gaseous connection with the air flow producer 70.

A passageway 65 is coupled to the separation chamber to direct air flow from an air exit 80, thereby producing an air flow through the separation chamber from the air intake to the air exit. An expansion chamber 30 is disposed within the passageway 65. The expansion chamber includes an entrance and an air exit each coupled to the passageway, a material exit, and a redirecting plate 35 disposed within the expansion chamber 30. Air flowing through the filter 40 transports a second, separate solid material of the mixture through the air exit of the filter 40 and into the expansion chamber 30 by way of the passageway 65 and entrance of the expansion chamber 30. At least a portion of the second solid material exits the expansion chamber 30 via the material exit of the expansion chamber 30. Air exits the expansion chamber 30 through the air exit to reenter the passageway 65, and ultimately the filter 40.

FIG. 2 shows an exemplary path of material within system 100. The materials that travel on the screening bed 10 encounter a fluidization chamber or hood 60. The chamber or hood 60 fluidizes the material travelling on the screening bed 10 using a negative pressure, vacuum, or air suction. The covers and side walls 28 assist in manipulating the air to be force from underneath the agitator openings instead of the sides or top of the screening bed 10. This augments the fluidization effect. The material travels to the expansion chamber 30. In the expansion chamber 30, the air and materials may contact a redirecting plate 35, which redirects the path of the air and materials. As the velocity of the air slows in the expansion chamber 30, the entrained materials fall to the bottom of the expansion chamber 40. The air flow producer 70 pushes the air through the expansion chamber 30 and also draws the air from the filter 40, which may be a cyclone, dust collector, baghouse or centrifugal device. An air flow producer 70 produces an air flow through the apparatus/system in the direction of the arrows illustrated in FIG. 2 by drawing air from the bottom of the screening bed 10 into the fluidization chamber or hood 60.

As illustrated within FIGS. 1, 2 and 3, system 100 can have more than one fluidization chamber 20, expansion chamber 30, and centrifugal filter 40. This allows for different air velocities to be utilized to separate materials with different densities or weight within the same unit. Similarly, the screening bed 10 may employ different star sizes and/or configurations or different gaps between the stars to screen the materials into more than two different size fractions. In exemplary embodiments, a volume of the expansion chamber 30, including a particular depth, width, height, and shape can be selected to obtain the desired static pressures and air flows in the expansion chamber 30 and the system 100 and to process the desired type and size/density of materials.

FIG. 4 shows an exemplary screening bed 10 has a series of shafts 16 having star-shaped agitators 22 adjustably and/or non-adjustably connected to rails 12. In this embodiment, the shafts 20 are positioned along the rails to help sort the materials as they pass through the screening device or bed 10. As the materials pass along the screening bed 10, materials may be sorted based on size by the agitators 22. The small elements that dropped through the star openings may be conveyed via a conveyor belt or may fall to a bin located proximate or underneath the screening bed 10 as illustrated on FIGS. 1 and 2. Similarly, the larger materials that remain on top of the screening bed 10 and that traveled to the end of the screening bed 10 may be collected or may be discharged into a collecting bin (not shown). The speed of the shaft 20/stars 22 on the screening bed 10 may be adjusted to improve the fluidization process as well as to allow for the proper sorting of long and thin pieces of materials.

When the screening bed 10 is in fluid connection with expansion chamber 40, the system 100 can sort by size and by weight. The heavier materials that passed through the fluidization chamber 40 but were not carried into the (e.g., centrifugal) filter 40 are screened through the screening bed 10. The large and thin/long pieces from the heavy fraction that were not screened through the stars openings are discharged at an end (E) of the screening bed 10. These materials may be referred to as "large heavies" while the heavier fraction that is screened through the stars openings may be referred to as "small heavies". The small heavies that dropped through the openings between the agitators 22 may be conveyed via a conveyor belt (C) or may fall to a bin located proximate or underneath the screening bed 20 as illustrated on FIGS. 1 and 2.

As can be seen from FIG. 3, the air flow travels from underneath the screening bed 10 into the fluidization chamber 30, thereby causing lighter density material to be encapsulated within the air flow while heavier material remains on the screening bed 10 for further screening through the agitator 22. The lighter material is carried by the air flow into the fluidization chamber 60, and further into an expansion chamber 30. In the expansion chamber 30, the air and light fraction of materials contained therein contact a redirecting plate 35, which redirects the path of the air and light fraction of materials to the bottom of the expansion chamber 30.

Velocity of the air slows as it enters the expansion chamber 30. When this occurs, the light fraction within the air falls to the bottom of the expansion chamber 30 and exits the system/apparatus via an exit such as, for example, a rotary valve. Use of a rotary valve allows for material to be discharged from the system/apparatus without allowing air to escape or enter the system/apparatus 100. The discharged material at the bottom of the expansion chamber 30 may be collected via a conveying system or may be discharged directly into a collecting bin located proximate or underneath the expansion chamber 30.

As can be seen, the air flow travels from the centrifugal filter to the air flow producer 70 where it exits the system/apparatus to the atmosphere. Moreover, an additional filter may be employed after the air flow producer 70 to further filter any residual solids that traveled from a filter 40 to the air flow producer 70. The air flow producer 70 produces air flow in the system 100 in the direction of the arrows illustrated in FIG. 2 by drawing air from a return side of the air flow producer device 50 and pushing air through a supply side of the air flow producer 50. The size of the air flow producing device can be adjusted to provide the desired air flow and pressures throughout the system 100. For example, a smaller/less powerful airflow producing device 50 may be utilized when it is desirable for smaller materials to be carried by the airflow. A larger/more powerful airflow producing device 50 may be utilized when it is desirable for larger materials to be carried by the airflow. In an exemplary embodiment, the air flow producer 70 is a 50-75 horsepower fan. The air flow producer 50 can have a variable speed control to control the air flow created by the air flow producer 50.

In one example, the air within the expansion chamber 30 flows from via an exit of the expansion chamber 30 through ducting and into a centrifugal filter 40. The centrifugal filter 40 removes additional solid material remaining within the air. The centrifugal filter 40 may direct the air in a circular (cyclone) manner, thereby forcing the remaining material within the air to the outside of the centrifugal filter 40. There, the remaining material falls to the bottom of the centrifugal filter 40 and exits the system/apparatus via an exit located at or near the bottom of the centrifugal filter 40. The exit may be, for example, a rotary valve, which prevents or minimizes air from entering or exiting the system/apparatus. This helps ensure air is drawn from the fluidization chamber or hood 60 to the expansion chamber 30 and into the centrifugal filter 40. This creates a vacuum effect.

Additionally or alternatively, other devices may be used to filter 40 the air and/or recover solid materials from the air that flows through the system/apparatus 100. For example, an inline filter may be used in the ducting or a dust collector, similar to a baghouse, may be employed in addition or substitution of the centrifugal filter 40.

Figure 4B:
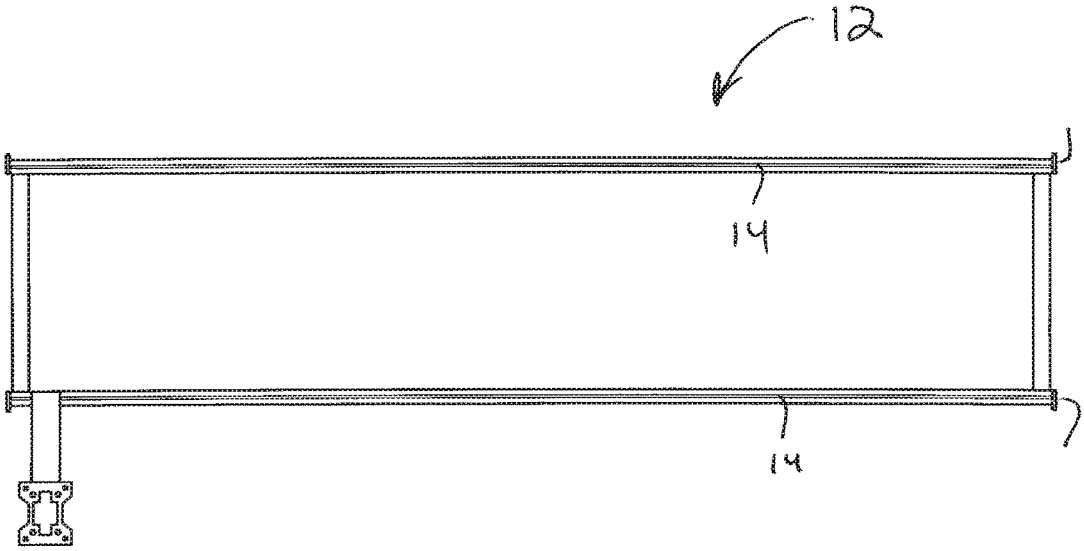
FIG. 4B shows a top view of exemplary frame of a screening bed.
Figure 4A:
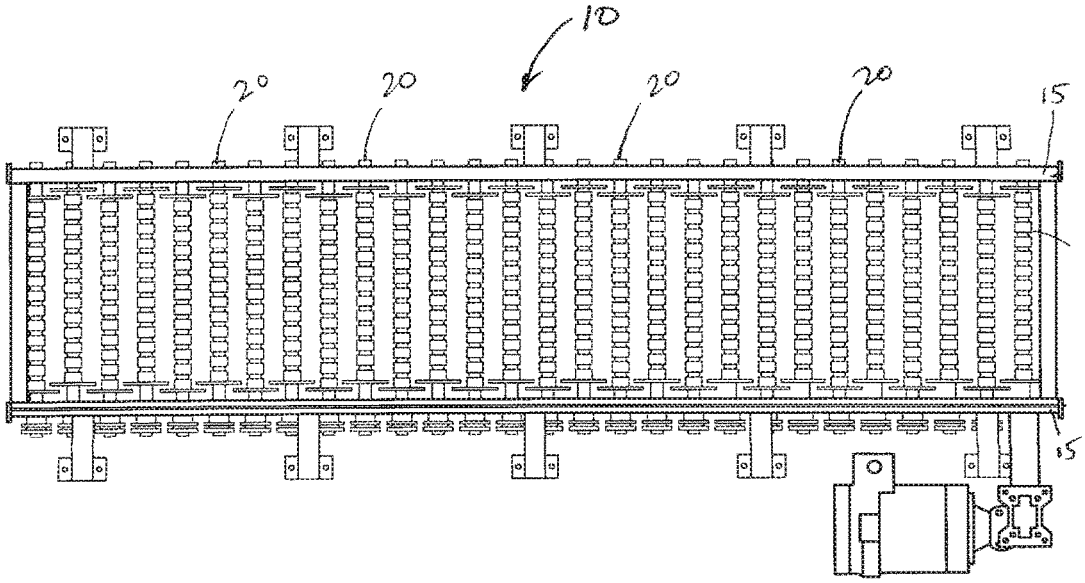
FIG. 4A shows an exemplary screening bed that is formed from a series of shafts having star agitators.

FIGS. 4A and 4B illustrate an exemplary screening bed 10, is a motor (not shown) driven platform having a frame 12 and a plurality of rotatable shafts 20 coupled within the frame 12 using bearings 26 and glide elements (optional). The plurality of shafts 20 are operationally coupled to the motor, e.g., using a belt or a chain (not shown). The axes of the plurality of shafts 20 are substantially parallel when coupled within the frame 12, which has a groove along the rail 15 of the frame 14. The platform has a plurality of screening spaces each having a predetermined spacing or variable spacing. In one example, the spacing between the shafts 20 may be varied by adjusting and readjusting the bearings 26 on the rail 15. Material placed on a top side of the platform is agitated by the plurality of rotating shafts/stars 22 (shown later), screening smaller material through the plurality of screening spaces while maintaining the larger material on the top side of the platform. There can be collection buckets or a conveyor underneath the platform or screening bed 10.

Figure 4C:
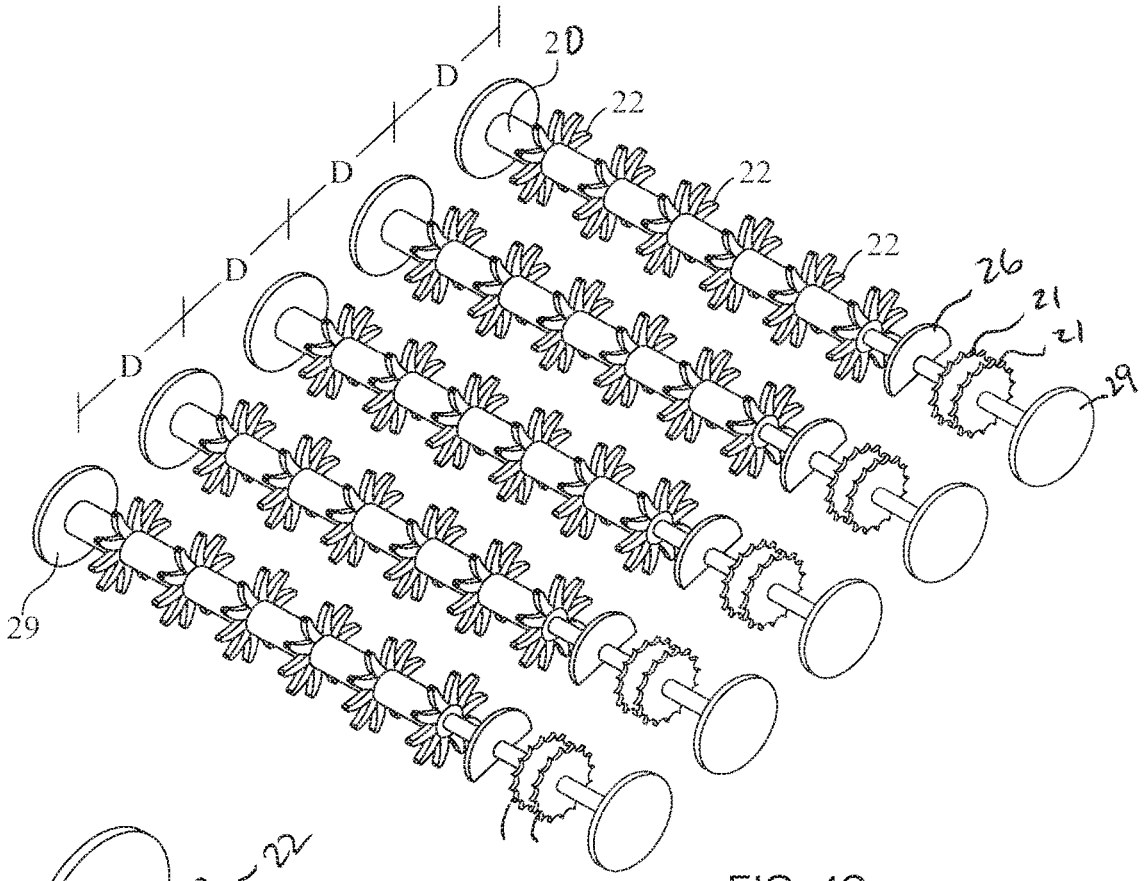
FIG. 4C shows a plurality of shafts that is included in the screening bed.
Figure 4D:
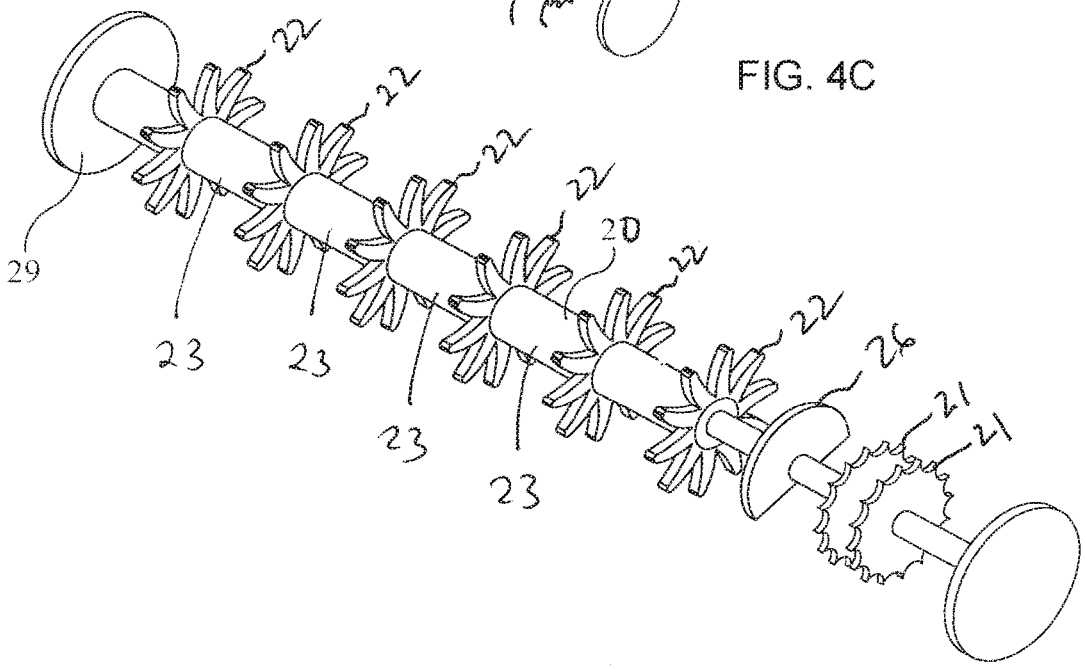
FIG. 4D shows an exemplary screening shaft.

FIGS. 4C and 4D show an example of a series of shafts 20 with star-shaped agitators 22 for size reduction. The shafts 20 are ordinary shafts, but have star-shaped agitators, which can be separated by spacers 23. The ends of the shafts have a bearing 26 to operatively connect the shafts to the frame 12, and gears 21 to engage a chain (not shown), which is operatively connected to a motor (not shown) that drives the shafts 20. Distance D represents the distance between the axis of the shafts 20. Cover plates 29 (optional) can be included on the shafts 20. The shafts may have one multiple gears 21 or bearings 26 based on the example.

Figure 4E:
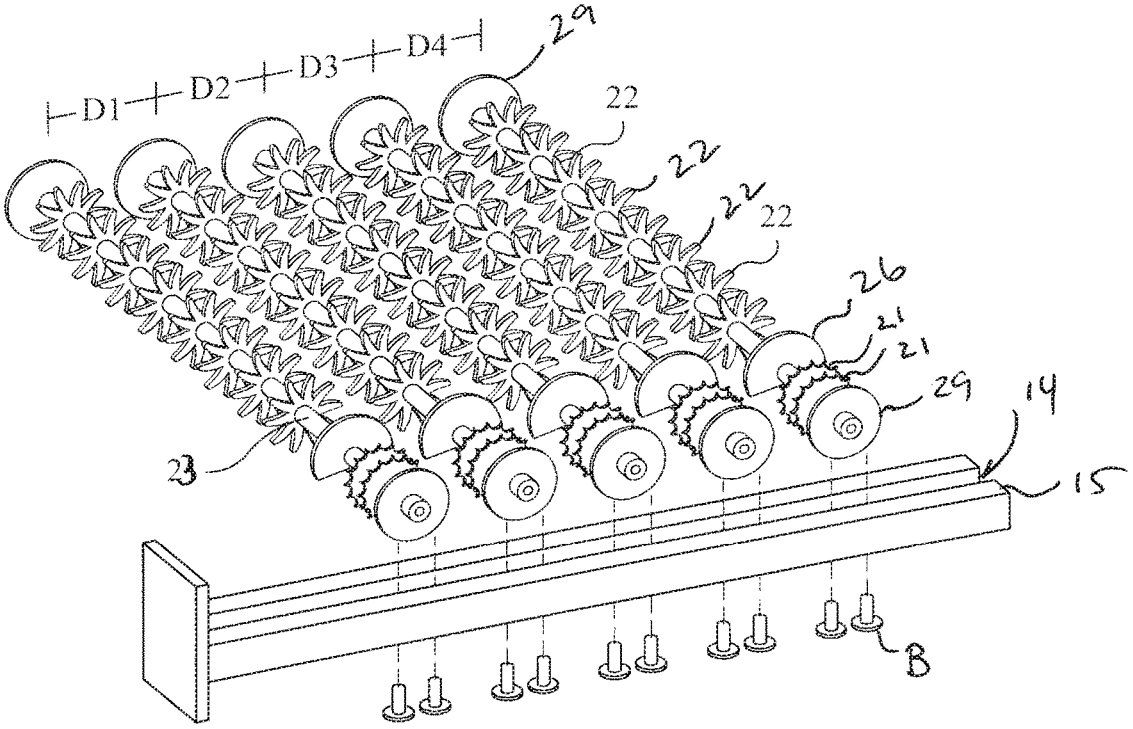
FIG. 4E shows an exemplary connection of the shafts to the frame of a screening bed.

FIG. 4E shows an example of a connection to the frame of the screening bed 10 that allows the distance (D1 through D2) between the shafts 20 to be varied. In this arrangement, the frame 12 can have two rails 15 (one shown) with a groove 14 or space in between the rail 15 of the frame 12. In one example, the bearing 26 on the shaft 20 is connected to the rail 15 and bolts B, which can be fed through the groove and tightened to lock the shaft in place along the rail 15 or frame 12. Further, the shaft 20 can be moved by loosening the bolts B, sliding the bearing 26 along the rail 15, and retightening the bolts B. The distance D between the shafts 20 may be optimized almost infinitely.

In operation, the system 100 receives a mixture having at least a first material, a second material and a third material. The mixture is placed on the screening bed 10 and conveyed along the screening bed 10 such that a first material is sorted by size from larger material by size and drop below, e.g., into a bucket or a conveyer. As the material moves along the screening bed 10, the second material of having a weight flows into the hood 30 and is sorted accordingly. Further, the third material, which is not of the general size to pass through the star-sized agitators 22 (e.g. long insulated wires) or of weight to be "vacuumed" into the hood 30, flows to the end of the screening bed 10 and can be further processed.

Figure 5:
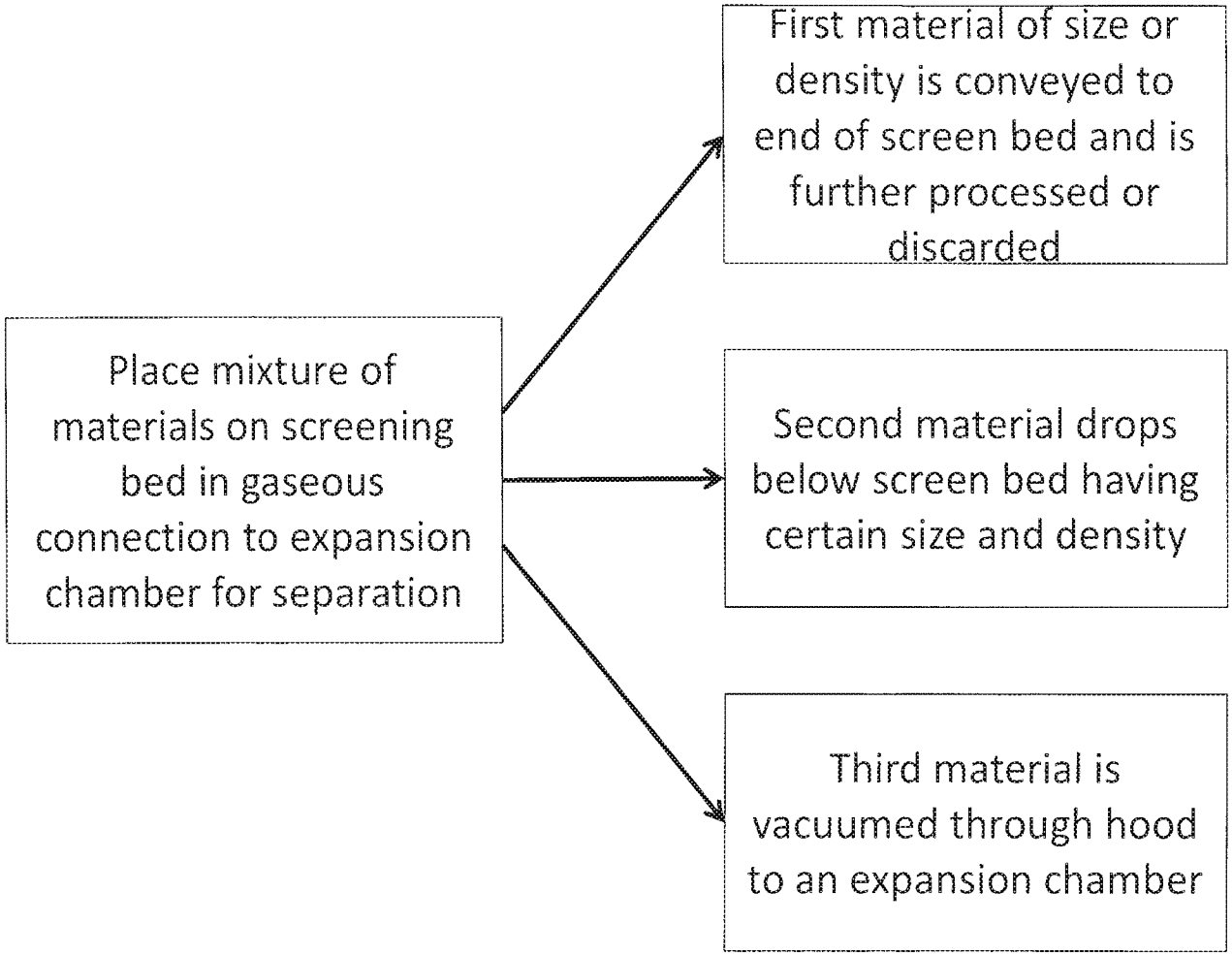
FIG. 5 shows one example of the separation process.

One embodiment of the separation process is shown in FIG. 5. One method for separating a mixture of materials from a waste stream includes separating heavier materials from lighter materials by (a) allowing the mixture to pass over a screening bed having a series of rotatable shafts with star-sized structures or agitators and/or (b) allowing the mixture to be exposed to a vacuum pressure while on the screening bed. The vacuum pressure can cause certain material to flow to a filter. One or more of the shafts may be adjustably connected along a pair of rails, which allows adjustments based on the mixture to be screened.

The sizes of the air flow producer 70, the passageways 65 and transitions through which the air flows, the expansion chamber 30, filter 40, fluidized chamber 60, and other components can be varied to obtain the desired static pressures and air flows throughout the system 100 and to process the desired type and size/density of materials.

The system 100 allows materials be separated by weight and size in a flexible manner. The heavier materials that passed through the fluidization chamber 60 but were not carried into the centrifugal filter 40 are screened through the star screening bed 10. The large and thin/long pieces from the heavy fraction that were not screened through openings between the stars openings are discharged at an end of the screening bed 10. Similarly, the large heavies that stayed on top of the screening bed 10 and that traveled to the end of the star screening bed 10 may be collected by a conveyor belt or may be discharged into a collecting bin at the end of the star screening bed 10. The speed of the stars on the star screening bed 10 may be adjusted to improve the fluidization process as well as to allow for the long and thin pieces of materials to be concentrated on the "large heavies" fraction.

The description above uses the terms heavy fraction and light fraction to describe the two streams of material to be separated. These terms are relative. As used herein, the terms heavy fraction and light fraction to describe the two streams of material to be separated. These terms are relative. For example, in one exemplary embodiment, the light fraction can include fabric, rubber, and insulated wire, and the heavy fraction can include wet wood and heavier metals, such as non-ferrous metals including aluminum, zinc, and brass. In another exemplary embodiment, the light fraction can include fabric, and the heavy fraction can include insulated wire. In one exemplary embodiment, the light fraction can include fabric, rubber, and insulated wire, and the heavy fraction can include wet wood and heavier metals, such as non-ferrous metals including aluminum, zinc, and brass. In another exemplary embodiment, the light fraction can include fabric, and the heavy fraction can include insulated wire. System 100 can be optimized to sort by size and density.

Although illustrative embodiments of the present disclosure have been described herein with reference to the accompanying drawings, it is to be understood that the present disclosure is not limited to those precise embodiments, and that various other changes and modifications may be made by one skilled in the art without departing from the scope or spirit of the disclosure.

What is claimed:

1. An apparatus for separating a mixture of solid materials, comprising: a) a screening bed that mechanically separates the mixture, the mixture including a first solid material, a second solid material, and a third material; b) an expansion chamber in gaseous communication with the screening bed, the expansion chamber receiving the second solid material, the second solid material being transferred to the expansion chamber by an air flow; c) a filter in gaseous communication with the expansion chamber, the filter receives air containing residual material from the expansion chamber, the filter further filters the residual material from the air; and d) an air flow producer in fluid communication with the filter, the air flow producing device producing an air flow directed from the screening bed to the air flow producer, wherein the screening bed includes a plurality of shafts having star-shaped agitators and the air flow is a vacuum from the screening bed through pathway, wherein the shafts have bearings that works together with glide elements along the rails so to allow the shafts to move along the rails.

2. The apparatus of claim 1, further comprising a fluidization chamber.

3. The apparatus of claim 1, wherein the expansion chamber includes a redirecting plate, whereby the redirecting plate redirects the path of the air and the lighter fraction of materials to a bottom of the expansion chamber.

4. The apparatus of claim 1, wherein the filter causes the air within it to move in a centrifugal pattern, the centrifugal pattern of the air causes the residual material in the air to concentrate at an exterior of the filter.

5. The apparatus of claim 1, wherein the screening bed has a series of rotatable shafts with star-shaped agitators, wherein one or more of the shafts are adjustably connected along a pair of rails.

6. The apparatus of claim 5, wherein the distance between the rotatable shafts with respect to the shafts is variable.

7. The apparatus of claim 5, wherein the star-shaped agitators have differing sizes.

8. The apparatus of claim 5, wherein the chamber has redirecting plate to modify the airflow through the chamber.

9. The apparatus of claim 1, wherein the screening bed has a cover and side walls to direct the flow of air from the screening bed.

* * * * *